US006944312B2

(12) United States Patent
Mason et al.

(10) Patent No.: US 6,944,312 B2
(45) Date of Patent: Sep. 13, 2005

(54) LAY-IN CEILING SPEAKER

(75) Inventors: John W. Mason, Roanoke, VA (US); Kevin G. Lane, Roanoke, VA (US)

(73) Assignee: Valcom, Inc., Roanake, VA (US)

( * ) Notice: Subject to any disclaimer, the term of this patent is extended or adjusted under 35 U.S.C. 154(b) by 153 days.

(21) Appl. No.: 09/881,499

(22) Filed: Jun. 14, 2001

(65) Prior Publication Data

US 2001/0053232 A1 Dec. 20, 2001

Related U.S. Application Data

(60) Provisional application No. 60/211,574, filed on Jun. 15, 2000.

(51) Int. Cl.[7] ..... H04R 25/00

(52) U.S. Cl. ..... 381/391; 381/189; 381/345; 381/391

(58) Field of Search ..... 381/162, 286–388, 381/391, 395, 189, 87; 181/171, 199, 141, 148, 150, 153

(56) References Cited

U.S. PATENT DOCUMENTS

| | | | | |
|---|---|---|---|---|
| 3,789,953 A | * | 2/1974 | Everitt | 181/199 |
| 3,811,532 A | | 5/1974 | Everitt | |
| 3,946,832 A | | 3/1976 | Takano et al. | |
| 3,989,909 A | * | 11/1976 | Hodsdon et al. | 381/391 |
| 3,993,345 A | | 11/1976 | Croup | |
| 4,439,643 A | * | 3/1984 | Schweizer | 381/391 |
| 4,509,192 A | | 4/1985 | Straughn | |
| 4,891,842 A | | 1/1990 | Green | |
| 4,923,032 A | | 5/1990 | Nuernberger | |
| 5,115,884 A | * | 5/1992 | Falco | 381/386 |
| 5,143,339 A | | 9/1992 | Ashcraft et al. | |
| 5,546,468 A | | 8/1996 | Beard | |
| 5,627,350 A | | 5/1997 | Kang | |
| 5,952,619 A | | 9/1999 | Kantor et al. | |

FOREIGN PATENT DOCUMENTS

| | | |
|---|---|---|
| EP | 0 422 322 A3 | 4/1991 |

* cited by examiner

*Primary Examiner*—Suhan Ni
(74) *Attorney, Agent, or Firm*—Craig A. Fieschko, Esq.; DeWitt Ross & Stevens S.C.

(57) ABSTRACT

A light weight fully assembled speaker enclosure is provided that includes a backbox having a peripheral edge; a grill that is crimped around the peripheral edge of the backbox, and a sound-baffle sheet disposed between the backbox and the grill, the sound-baffle sheet having an opening for placement of a speaker. Also provided is a speaker system having an audio speaker; a backbox having a peripheral edge; a grill that is crimped around the peripheral edge of the backbox and that is affixed to the speaker; and a sound-baffle sheet disposed between the backbox and the grill, the sound-baffle sheet having an opening for placement of the speaker.

20 Claims, 5 Drawing Sheets

LAY-IN CEILING SPEAKER

CROSS-REFERENCE TO RELATED APPLICATION

This application claims priority under 35 U.S.C. §119(e) to co-pending provisional patent application Ser. No. 60/211,574, filed Jun. 15, 2000, the entirety of which is incorporated by reference herein.

FIELD OF THE INVENTION

The present invention relates to speakers for placement in ceilings, walls, and the like. The present invention is specifically directed to a low profile, lightweight, fully assembled lay-in speaker system which replaces a standard ceiling tile.

BACKGROUND OF THE INVENTION

Conventional speakers oftentimes require holes to be cut in a ceiling tile so that the speakers can be placed in the holes. Cutting ceiling tiles is messy, costly, and time-consuming. It also decreases the structural integrity of the ceiling tile. Conventional speakers also require substantial expense of time and labor for the installation, and cost in terms of hardware required for mounting.

Access to conventionally mounted speakers is also problematic. Particularly in large buildings, such as theaters or offices, access to conventionally mounted speakers for cleaning, maintenance, and adjustment is cumbersome and labor intensive. Additionally, individual speaker volume control is not readily accessible for conventionally mounted speakers.

Furthermore, conventional speakers are heavy, thereby requiring additional support, such as wire hangers, to connect the speaker to the ceiling. See, for example, U.S. Pat. No. 4,923,032 to Nuernberger.

In addition, conventional speaker do not provide a minimum three-hour burn rating. While building codes require burn-resistant materials to be used in ceiling tiles themselves, building and fire codes do not require burn-resistant materials to be used in speakers, creating a potential fire hazard. Conventional backboxes are made of a metal, such as steel, which do not provide a three-hour burn rating. Thus, a fire hazard exists wherever a conventional speaker is located.

SUMMARY OF THE INVENTION

The present invention, which is defined by the claims set out at the end of this disclosure, is intended to solve at least some of the problems noted above. A speaker enclosure is provided that includes a backbox having a peripheral edge; a grill that is crimped around the peripheral edge of the backbox, and a sound-baffle sheet disposed between the backbox and the grill. An opening is placed in the sound-baffle sheet for placement of a speaker.

Also provided is a speaker system having a speaker, a backbox having a peripheral edge, a grill that is crimped around the peripheral edge of the backbox and to which is affixed a speaker, and a sound-baffle sheet disposed between the backbox and the grill. The crimping of the grill serves several other purposes. It makes a nearly airtight seal with the grill and sound-baffle sheet, which minimizes possible smoke seepage between the room and the ceiling. Further, it prevents sound waves from the front of the speaker from entering the enclosure and canceling at various frequency points. The sound-baffle sheet has an opening in it to accommodate the speaker.

Crimping the grill over the backbox increases the strength of the backbox, thereby providing structural integrity both to the grill and backbox. In addition, the backbox preferably is made of a material that has good high temperature insulation properties to achieve a three-hour burn rating.

The speaker system of the present invention offers a number of other advantages over speakers known to the prior art. Because of its size and dimensions, there is no need to cut ceiling tiles to accommodate the speaker, which eliminates the mess and difficulty normally present with installing speaker systems in ceilings. The lay-in speaker system also provides easy access for maintenance and repair by providing access through adjacent ceiling tiles. The speaker system also provides an inconspicuous front accessible volume control for the speaker. In addition, the integral backbox meets or exceeds ASTM E84 flame and smoke test with 3 hour burn.

Further advantages, features, and objects of the invention are apparent from the following detailed description of the invention in conjunction with the associated drawings.

DETAILED DESCRIPTION OF THE INVENTION

Figure 1:
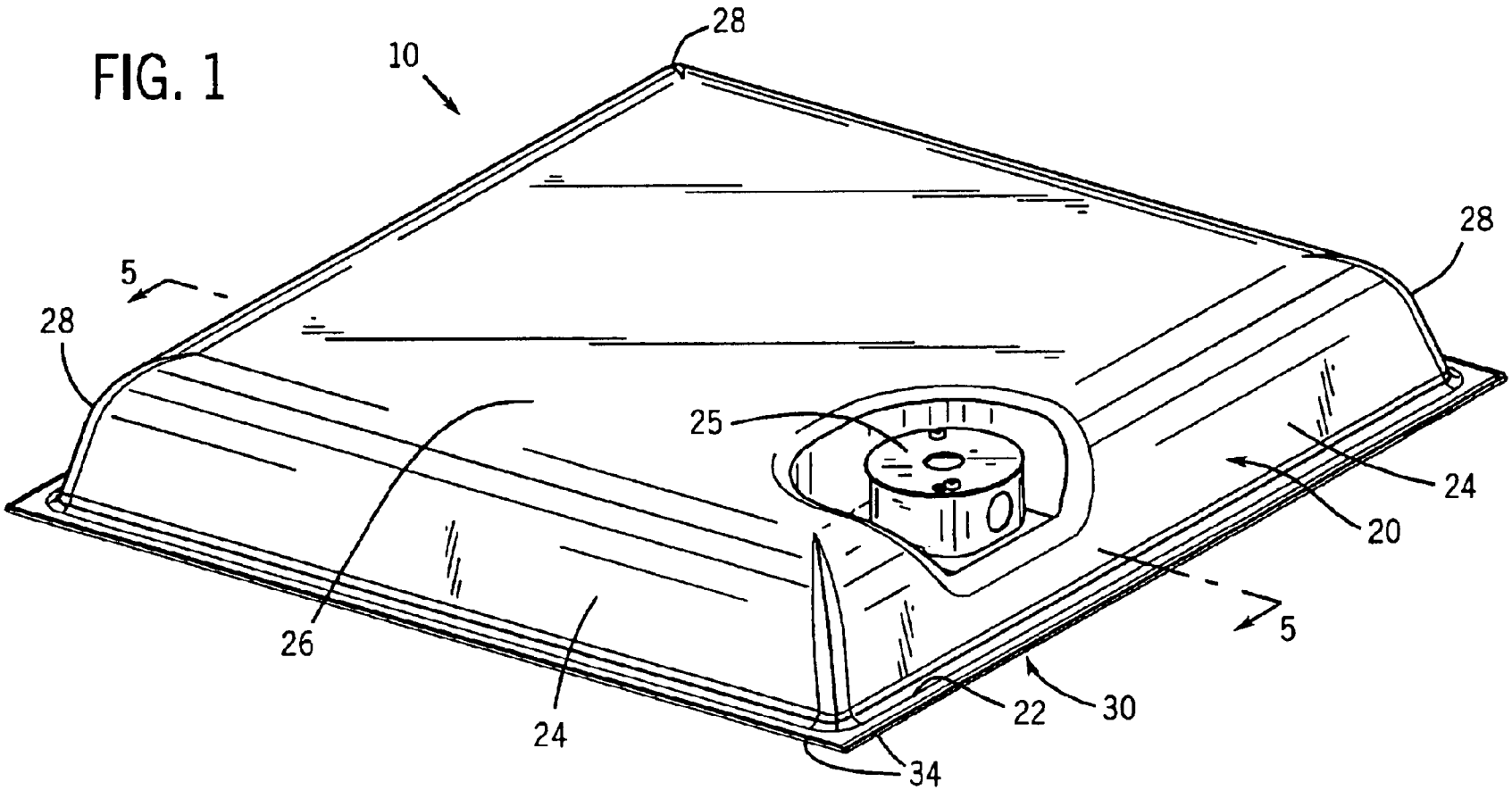
FIG. 1 is a perspective view of a preferred embodiment of a speaker enclosure made in accordance with the invention.

Referring now to the drawings, a first preferred embodiment of the speaker enclosure system in accordance with the present invention is illustrated in FIG. 1 at the reference numeral 10. The speaker enclosure system 10 is a ceiling speaker preferably having the same size as a standard ceiling tile. As such, the speaker enclosure system 10 is designed to replace an entire ceiling tile and to rest on the same tile framework support. Thus, the speaker enclosure system 10 does not require any additional framework or support for placement on ceiling other than the framework already installed for the tile. The speaker enclosure system 10 therefore blends in with the rest of the ceiling tiles and does not obstruct access to, or the view of, the ceiling.

Unlike conventional ceiling speakers, there is no need to cut a ceiling tile. A standard 2 foot by 2 foot size is useful for the speaker enclosure 10, although the speaker enclosure system 10 can be made of virtually any size to match the size of the existing ceiling tiles.

In a preferred embodiment shown in FIG. 1, the speaker enclosure system 10 has a backbox 20, which encloses the speaker in order to comply with building codes. The backbox 20 includes a peripheral edge 22, walls 24 and an upper surface 26. As illustrated, the walls 24 are angled and slightly curved. It is within the scope of the present invention to provide walls of other shapes if desired. The walls 24 meet at edges 28, which are slightly curved as illustrated. Backboxes having other shapes and sizes are well within the scope of this invention. The upper surface 26 of the backbox 20 includes an electrical connection box 25, known to the art for supplying electricity to the speaker.

Preferably, the backbox 20 is a concave, molded, one-piece form having the top surface 26, sides 24 and an edge 22. More preferred is a concave, molded, one-piece fiberglass, mineral fiber, or other suitable fiber-covered material, form enclosed on one side by a foil or other suitable metallic coating. The fiberglass and foil combination provides a light-weight construction.

The backbox 20 also preferably is made of a material that is flame resistant. More preferably, it has a three-hour burn rating. The fiberglass and foil combination provides such a three-hour burn rating. The material preferably passes an American Society for Testing and Materials (ASTM) E84 flame and smoke test, which is a standard test method for surface burning characteristics of building materials. The method assesses the spread of flame on the surface of a material and is often referred to as the "Tunnel Test." The test involves installing a sample of material 20 inches wide and 25 feet long as the ceiling of a horizontal test chamber. The material is exposed to a gas flame on one end of the tunnel for a period of 10 minutes. The rate of flame front progression on the material is compared to selected standards and calculations made to produce a flame spread rating. The fiberglass and foil combination pass the ASTM E84 test. Also useful is a backbox 20 material that passes a Underwriters Laboratories (UL) 181 erosion and impact test. This test measures the fire resistance and surface burning characteristics of materials and fabrics, as well as ventilation characteristics of products installed in air ducts. The Standard evaluates a risk of fire, electric shock, or injury to persons, using the appropriate additional component and end-product requirements as necessary to maintain the level of safety for the user of the product as originally anticipated by the intent of this Standard. The test is designed for any product that contains features, characteristics, components, materials, or systems that are installed in air ducts. Products are classified based on their combustibility.

Figure 2A:
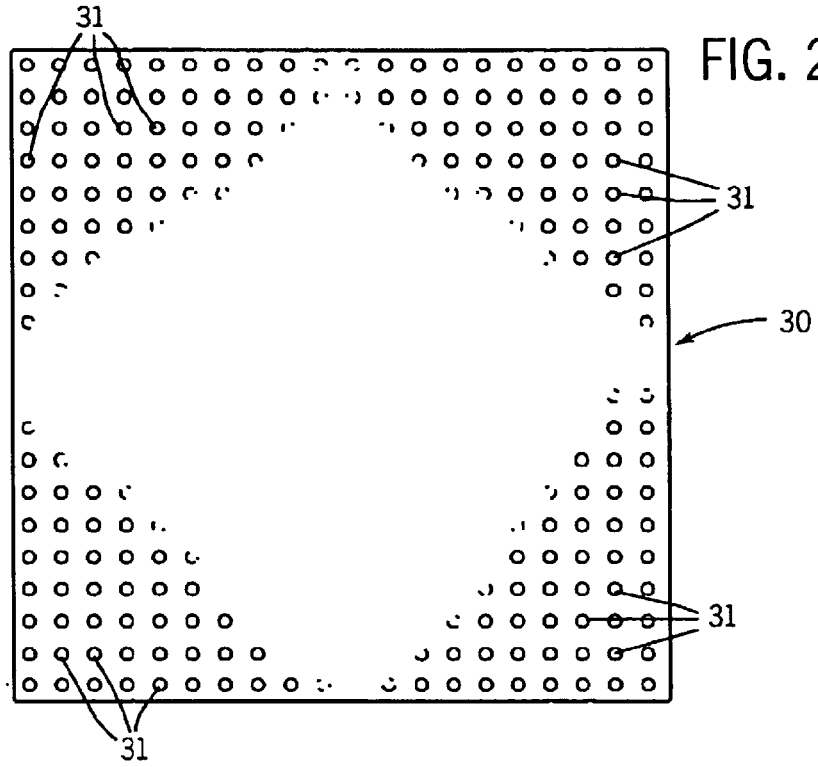
FIG. 2A is a top plan view of a preferred embodiment of a grill made in accordance with the invention.
Figure 2B:
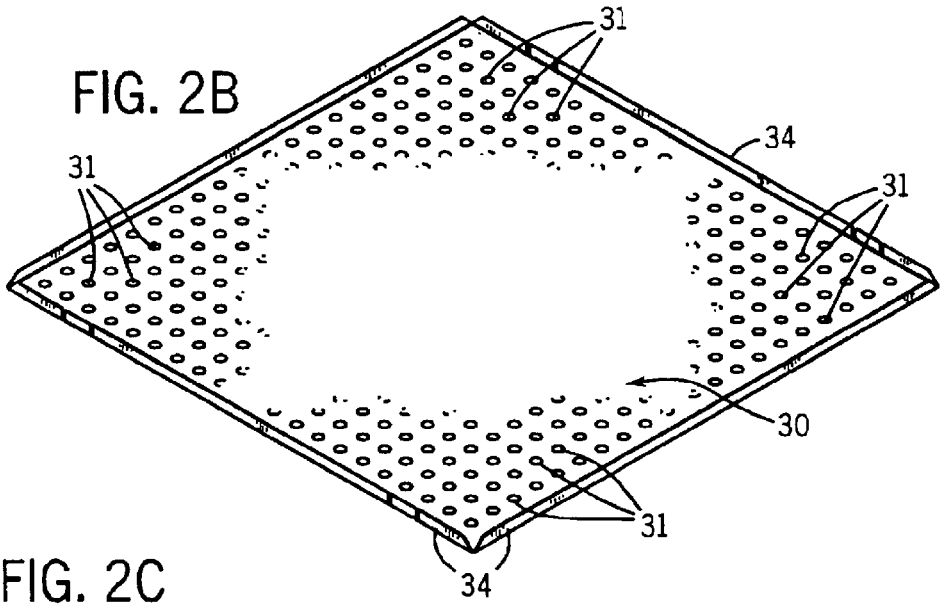
FIG. 2B is a perspective view of the grill of FIG. 2A.
Figure 2C:
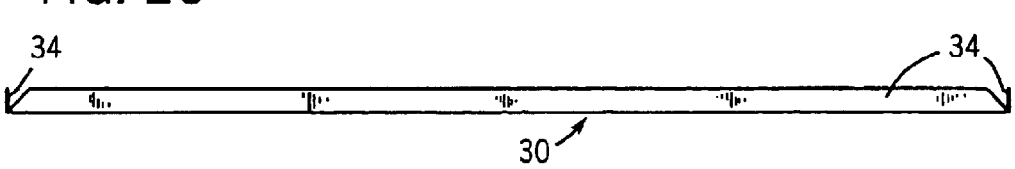
FIG. 2C is a side plan view of the grill of FIG. 2A.

Illustrated in FIGS. 2A–C, the speaker enclosure system 10 also includes a grill 30 that is crimped at edges 34, as illustrated in FIG. 1. The edges 34 are designed to crimp around the peripheral edge 22 of the backbox 20. The backbox 20 can also be attached to the grill 30 by other means such as adhesive, mechanical fasteners or an overlying piece to press the backbox 20 against the grill 30.

A preferred grill 30 is illustrated in FIGS. 2A–C. The grill 30 preferably is a perforated sheet designed to allow sound from a speaker 50 (illustrated in FIG. 4) to pass through it. Preferably, the perforations 31 are large enough to allow a screwdriver or similar device to be inserted through them. This permits adjustment of a volume control (not shown) on the speaker 50, which is shown later in FIG. 4. Conventional grills typically have smaller perforations through which do not accommodate a screwdriver or other similar tuning device. Thus, to adjust the volume on a speaker having a conventional grill, a hole must be drilled to enlarge the perforation or a speaker adjustment knob must be placed on the exterior surface of the grill.

Figure 3A:
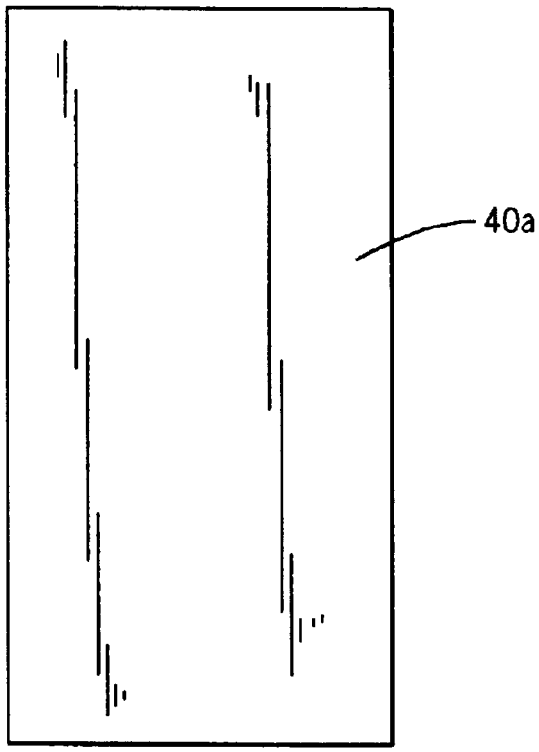
FIG. 3A is a top plan view of a preferred embodiment of a sound-baffle sheet without the speaker opening, made in accordance with the invention.
Figure 3B:
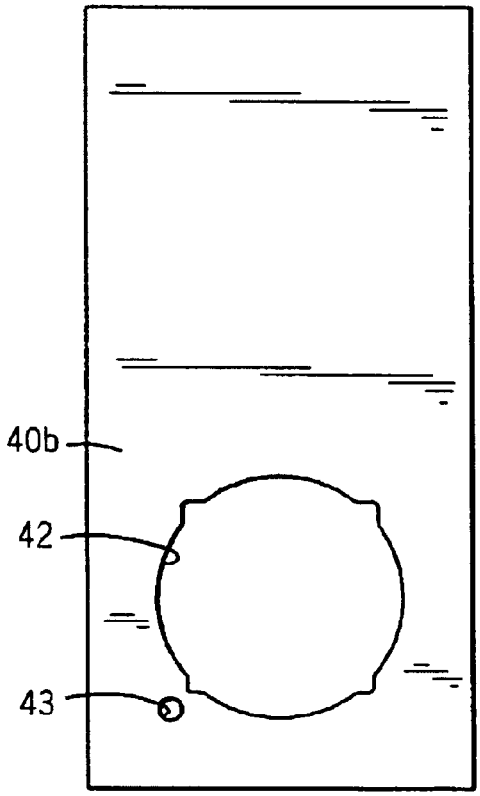
FIG. 3B is a top plan view of the sound-baffle sheet of FIG. 3A, which includes a speaker opening.
Figure 4:
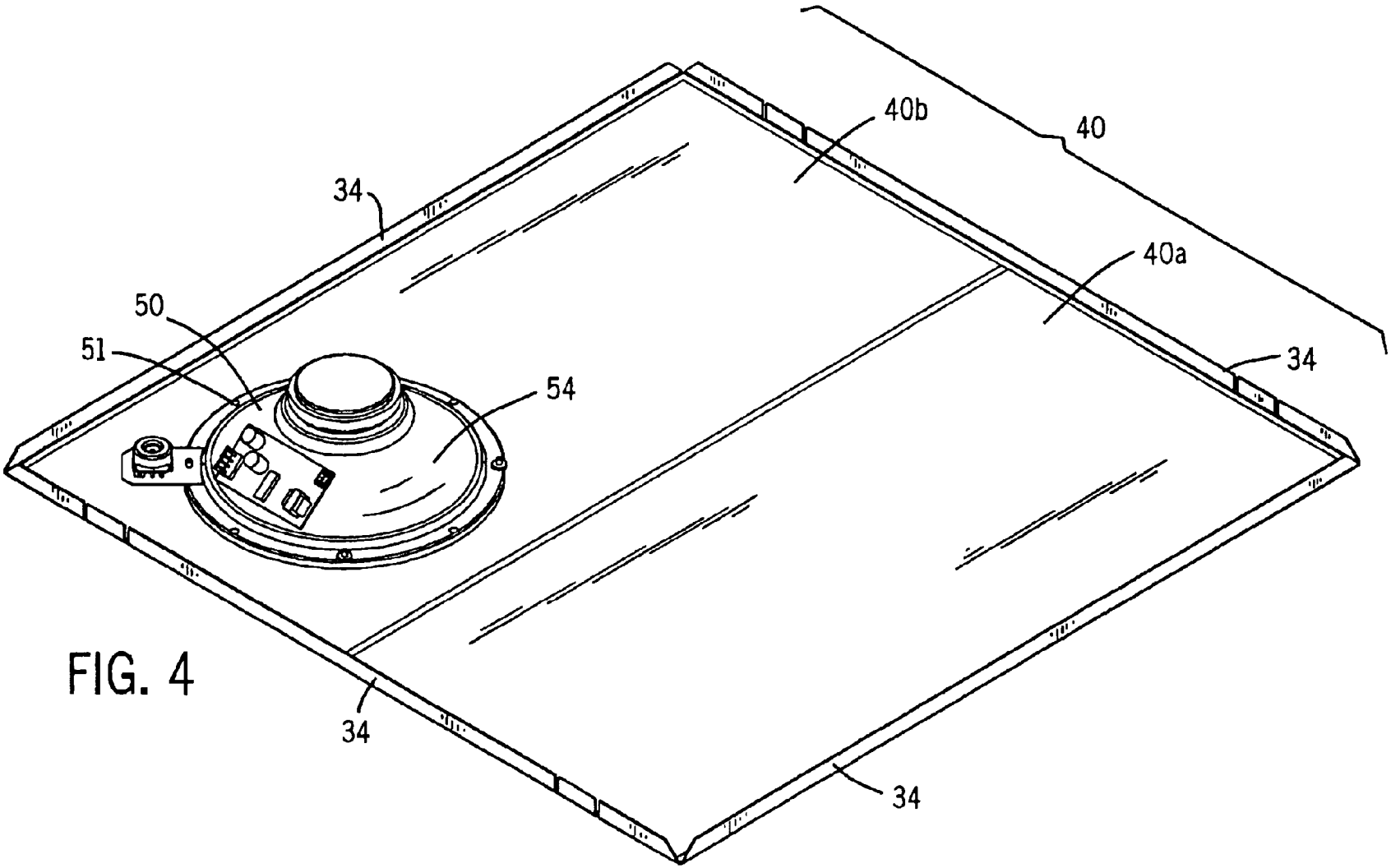
FIG. 4 is a perspective view illustrating the ventral side of the speaker system, which includes the grill, sound-baffle sheet, and speaker made in accordance with the invention.

Referring to FIG. 3A, a sound-baffle sheet 40, preferably made of vinyl or thin MYLAR, is disposed between the grill 30 and the backbox 20. Preferably, the sound-baffle sheet 40 is constructed of two pieces 40*a* and 40*b* that are placed side-by-side as is shown in FIG. 4. However, the sound-baffle sheet 40 can be constructed of a single piece. A series of openings 42 are cut in the sound-baffle sheet 40*b* as is shown in FIG. 3B. Typically, the size of the opening 42 approximates the diameter of the speaker 50. A second opening 43 of appropriate dimension may be added to the sound baffle sheet away from the speaker to introduce tuning of the enclosure to improve the low frequency response of the unit.

The speaker 50 is placed over the opening 42 of the sound-baffle sheet 40*b* as is illustrated in FIG. 4. The speaker 50 is then attached to the grill 30. Preferably, the attachment is permanent, such as by rivets, nuts and bolts or other attachment devices 51 attaching the speaker 50 to the grill 30 through the perforations in the grill 30.

Referring to FIG. 4, the sound-baffle sheet 40 forms an effective acoustical baffle. Sound waves emitted from the baffle 54 of the speaker 50 exit through the perforations of grill 30. Because sound waves can return to the speaker enclosure system 10 through the perforations 31, which tends to distort or dampen sound and is not desired, the sound-baffle sheet 40 acts to prevent sound waves from reentering the speaker 50. Thus, the sound moves into a room and is not dampened or canceled. The speaker 50 may be any speaker known to the art.

Figure 5:
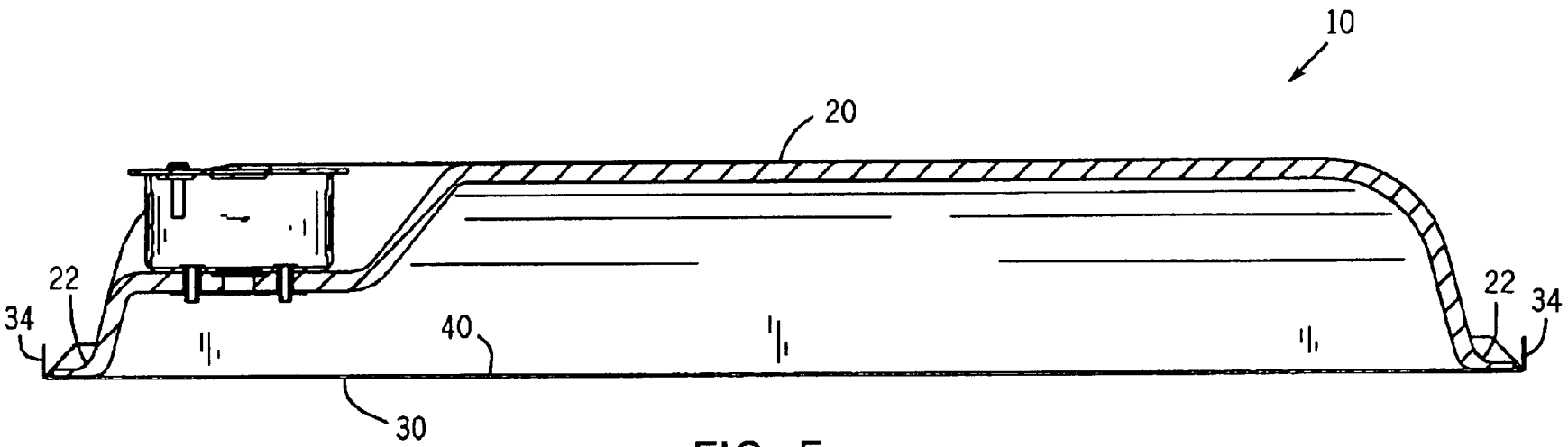
FIG. 5 is a cross-sectional view of the speaker system illustrated at lines 5—5 in FIG. 1.

Illustrated in FIG. 5, the grill 30 is secured to the backbox 20 by crimping the edges 34 of the grill 30 around the peripheral edge 22 of the backbox 20. FIG. 5 shows the backbox 20 and the grill 30 before the grill edges 34 are bent over the peripheral edge of the backbox 20. The crimping strengthens the backbox 20 and grill 30 combination, thereby providing additional structural integrity to the combination. The crimping also provides an economical method of speaker construction by eliminating the need for additional hardware to hold the speaker enclosure together. The elimination of additional hardware also reduces the cost of the speaker enclosure as a whole. In addition, crimping provides an easy and reversible means to disengage the backbox 20 from the grill 30 if it is necessary to separate the two.

The speaker enclosure 10 can also be manufactured with a sound masking generator built into the system. The appearance of the grill 30 is appropriate for the sound of the sound masking generator, i.e, it sounds like air coming from a ventilation grill. The unit has an appearance similar to a ventilation grill.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

For example, the speaker enclosure 10 can be used in a ceiling or a wall. The speaker enclosure 10 can be placed where two adjacent walls meet, preferably near the ceiling.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A speaker enclosure system comprising:

(a) a backbox having a backbox interior bounded by a peripheral edge, the peripheral edge having side walls extending therefrom to join an upper surface spaced from the peripheral edge, the upper surface extending between the side walls;

(b) a grill having an interior surface adjacent the backbox interior and an exterior surface adjacent a backbox exterior, the grill resting upon and extending across the peripheral edge of the backbox whereby the entirety of the backbox is situated above and within the boundaries of the interior surface of the grill, with the grill bearing perforations extending across the entirety of the area bounded by the peripheral edge of the backbox;

(c) a speaker within the backbox interior, the speaker being spaced from the peripheral edge to rest upon a portion of the interior surface of the grill;

(d) one or more sound-baffle sheets sitnated upon the interior surface of the grill, and extending between the speaker and the peripheral edge of the backbox, whereby the sound-baffle sheets mask the backbox interior from the backbox exterior.

2. The speaker enclosure system of claim 1, wherein the grill is releasibly attached to the backbox.

3. The speaker enclosure system of claim 2, wherein the grill includes an edge crimped about the peripheral edge of the backbox.

4. The speaker enclosure of claim 1, wherein the backbox is a concave, molded, one-piece form.

5. The speaker enclosure of claim 4, wherein the form comprises fiberglass or mineral fiber.

6. The speaker enclosure of claim 4, wherein the backbox has an interior surface adjacent the backbox interior, and an opposing exterior surface, wherein at least one of the interior and exterior surfaces is covered with foil.

7. The speaker enclosure of claim 1 wherein the speaker is affixed to the grill.

8. The speaker enclosure of claim 1 wherein the depth of the backbox, as measured between the interior surface of the grill and the upper surface of the backbox from a direction oriented perpendicular to the interior surface of the grill, is substantiality less than the width and length of the backbox as measured in directions oriented parallel to the interior surface of the grill.

9. A speaker enclosure system comprising:

(a) a backbox having a peripheral edge laterally bounding the entirety of the backbox, with the peripheral edge extending about a backbox interior;

(b) a grill having a crimping edge bounding an interior surface and an exterior surface, the interior surface resting upon the peripheral edge and the crimping edge being crimped to curve about the peripheral edge;

(c) a speaker affixed to he interior surface of the grill; and (d) a sound-baffle sheet extending across the interior surface of the grill between the peripheral edge and the speaker.

10. The speaker enclosure system of claim 9, wherein the backbox is a concave, molded, one-piece form.

11. The speaker enclosure system of claim 10, wherein the form comprises fiberglass.

12. The speaker enclosure system of claim 10, wherein the backbox has an interior surface adjacent the backbox interior, and an opposing exterior surface, wherein at least one of the interior and exterior surfaces is covered with foil.

13. The speaker enclosure of claim 9 wherein the depth of the backbox as measured from a direction oriented perpendicular to the interior surface of the grill is substantially less than the width and length of the backbox as measured in directions oriented parallel to the interior surface of the grill.

14. A speaker enclosure system comprising:

a. a backbox having sidewalls extending between a peripheral edge and an upper surface, with a backbox interior being defined adjacent the upper surface and between the sidewalls, and wherein the peripheral edge laterally bounds the entirety of the backbox;

b. a speaker situated within the backbox interior, the speaker being spaced from the peripheral edge;

c. one or more sound baffle sheets extending between the peripheral edge and the speaker; and d. a grill whereupon the speaker is affixed, the grill being situated upon and crimped to curve about the peripheral edge.

15. The speaker enclosure system of claim 14 wherein the sound baffle sheets resting upon the grill and having a speaker opening defined therein, wherein the speaker is situated within the speaker opening.

16. The speaker enclosure system of claim 15 wherein the sound baffle sheets have at least one tuning opening defined therein, each tuning opening being smaller than the speaker opening and being spaced from the speaker opening.

17. The speaker enclosure system of claim 14 wherein the sound baffle sheets and speaker mask at least substantially the entirety of the backbox interior from the grill.

18. The speaker enclosure system of claim 14 wherein the backbox has an electrical supply box moaned thereon outside the backbox interior.

19. The speaker enclosure system of claim 14 wherein the crimping edge is also crimped about the sound baffle sheets.

20. The speaker enclosure of claim 14 wherein the depth of the backbox as measured between the grill and the upper surface of the backbox is substantially less than the width and length of the measured in direction oriented generally parallel to the grill.

* * * * *